United States Patent [19]

Pezzoli

[11] Patent Number: 5,050,648

[45] Date of Patent: Sep. 24, 1991

[54] SYSTEM TO CONTROL WEFT TENSION IN A LOOM WITH CONTINUOUS WEFT FEED

[75] Inventor: Luigi Pezzoli, Leffe, Italy

[73] Assignee: Vamatex S.p.A., Villa Di Serio, Italy

[21] Appl. No.: 389,974

[22] Filed: Aug. 7, 1989

[30] Foreign Application Priority Data

Sep. 8, 1988 [IT] Italy ..... 21864 A/88

[51] Int. Cl.[5] ..... D03D 47/38

[52] U.S. Cl. ..... 139/450; 139/370.2; 139/452; 242/147 R

[58] Field of Search ..... 139/450, 370.2, 452, 139/194, 435; 242/47.01, 156.2, 156.1, 156, 147 R, 155 M

[56] References Cited

U.S. PATENT DOCUMENTS

| | | | |
|---|---|---|---|
| 3,938,119 | 2/1976 | Schwartz | 139/370.2 X |
| 4,010,915 | 3/1977 | Strutz et al. | 242/147 R |
| 4,359,068 | 11/1982 | Loepfe et al. | 139/450 X |
| 4,420,123 | 12/1983 | Fox et al. | 242/147 R |
| 4,768,729 | 9/1988 | Jacobsson | 242/147 R |
| 4,781,224 | 11/1988 | Gotoh et al. | 139/452 |
| 4,792,101 | 12/1988 | Van Bogaert et al. | 139/452 |
| 4,817,681 | 4/1989 | Krumm et al. | 139/370.2 |

FOREIGN PATENT DOCUMENTS

| | | | |
|---|---|---|---|
| 0246182 | 11/1987 | European Pat. Off. . | |
| 0256519 | 2/1988 | European Pat. Off. . | |
| 8713752 | 12/1987 | Fed. Rep. of Germany . | |
| 2428094 | 1/1980 | France . | |
| 2568595 | 2/1986 | France . | |
| 1203009 | 6/1983 | U.S.S.R. | 139/370.2 |

*Primary Examiner*—Andrew M. Falik

*Attorney, Agent, or Firm*—Young & Thompson

[57] ABSTRACT

In a system for automatically controlling the tension of weft yarns fed to a loom with continuous weft feed, the extent of braking of the weft yarn is controlled based on signals output from a device for measuring weft yarn tension. Specifically, signals from a weft yarn tension measuring device are output to an electronic interface unit, which processes those signals and directs an actuator to brake the weft yarn more heavily when the detected tension is below a predetermined level, and less heavily when the detected tension is above a predetermined level.

10 Claims, 1 Drawing Sheet

SYSTEM TO CONTROL WEFT TENSION IN A LOOM WITH CONTINUOUS WEFT FEED

BACKROUND OF THE INVENTION

It is known that economy of production in modern weaving is essentially based on two factors:

1—high productivity of the machines (looms);

2—the shortest possible dead times for changing the articles and for preparing the changed articles.

Both of these factors are influenced by the adjustment of the weft yarn tension. In fact, the efficiency and thus the productivity of a loom—especially in the case of a high—performance loom are greatly affected by the various weft tension adjustments, as well as the weft tension variations in relation to the desired, but unachieved continuous characteristics as concern dyeing pigments, spooling oils and production processes in gerneal. Furthermore, a loom working with a new yarn, or with a yarn belonging to a different lot, may require—and it usually does—a new tension adjustment; this is now done by manual intervention and the speed of the adjustment depends on the skill of the technician.

The present invention proposes to automate the process of weft yarn tension adjustment in weaving looms.

It is known that most of these looms and, above all, the modern looms with continuous weft feed, are equipped with a weft feeder having yarn brake means, and with a sensor controlling the weft picking, or warp stop motion device, usually positioned downstream of the brake means and upstream of the device for changing the colors in the loom.

SUMMARY OF THE INVENTION

In a loom thus equipped, the present invention provides for a system to automatically control the tension of the weft yarns fed thereto, characterized in that it makes use of signals from the warp stop motion device, representing the value of weft yarn tension, which are suitably processed into an electronic interface circuit, so as to control, through an actuator, the braking of the yarn and to restore its tension as desired.

The desired tension can be a reference tension preset in the electronic interface circuit, or it can be a tension already prearranged to be variable in the loom working cycle, in which case it is modulated by means of the signal from the warp stop motion device.

As an alternative to the signals from the warp stop motion device, use can be made—even if the costs will be slightly higher—of signals representing the value of weft yarn tension, sent from a special tensiometer arranged on the weft yarn path between the weft feeder and the loom.

In order to control weft yarn braking, the actuator may act on the brake means already provided at the outlet of the weft feeder, or on a braking device provided for the purpose downstream of the weft feeder.

BRIEF DESCRIPTION OF THE DRAWINGS

The invention is now described in further deatail, with reference to the accompanying drawing, in which.

DESCRIPTION OF THE PREFERRED EMBODIMENTS

Figure 1:
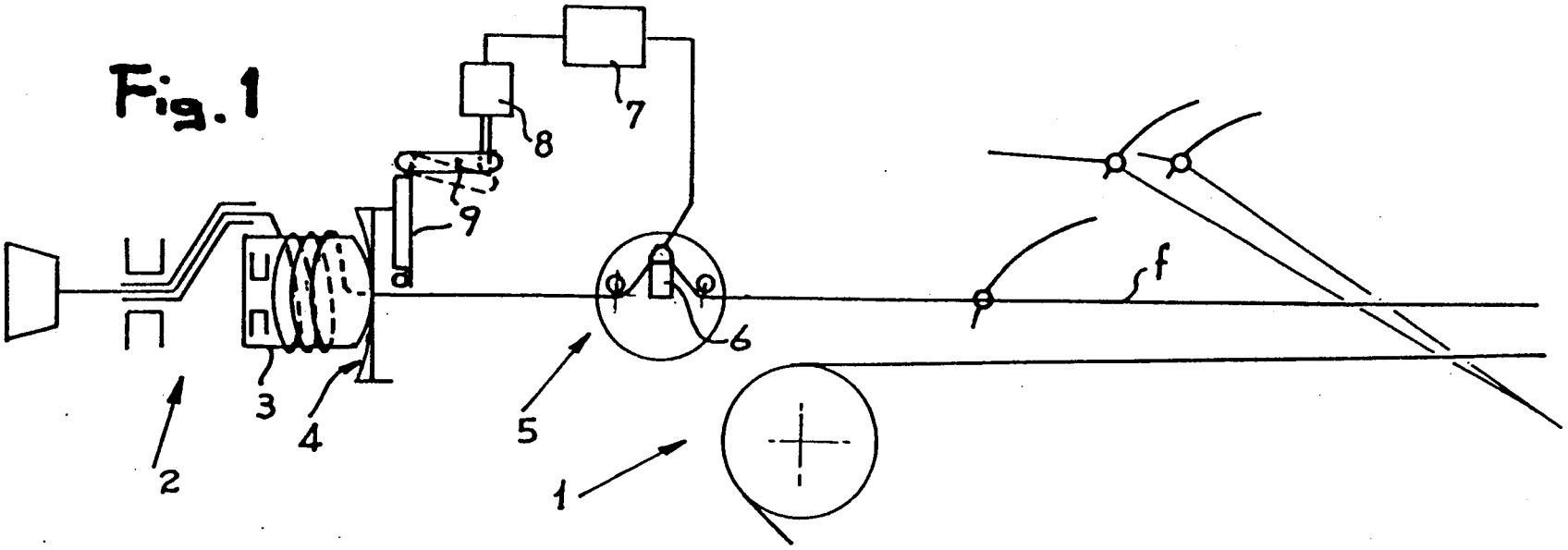
FIGS. 1 and 2 are schematic side views illustrating two different embodiments of the system according to the invention.

The diagram of FIG. 1 illustrates a continuous weft loom 1, to which the weft yarn is fed by a weft feeder 2 having a weft yarn winding drum 3 on which acts a brake means 4.

A warp stop motion device 5 is arranged between the weft feeder 2 and the loom 1, upstream of the yarn-changing device.

According to the invention, the warp stop motion device is of the type adapted to send a signal of intensity proportional to the rubbing of the weft being picked onto a specially prearranged element 6 therof, that is, a signal proportional to the tension of said weft.

Always according to the invention, said signal—suitably processed in a special electronic interface circuit 7—is sent to an actuator 8 provided to control, by means of suitable leverages 9, the brake means 4 of the weft feeder 2. The braking action imparted by said means will thus depend on the weft yarn tension detected by the warp stop motion device 5.

Figure 2:
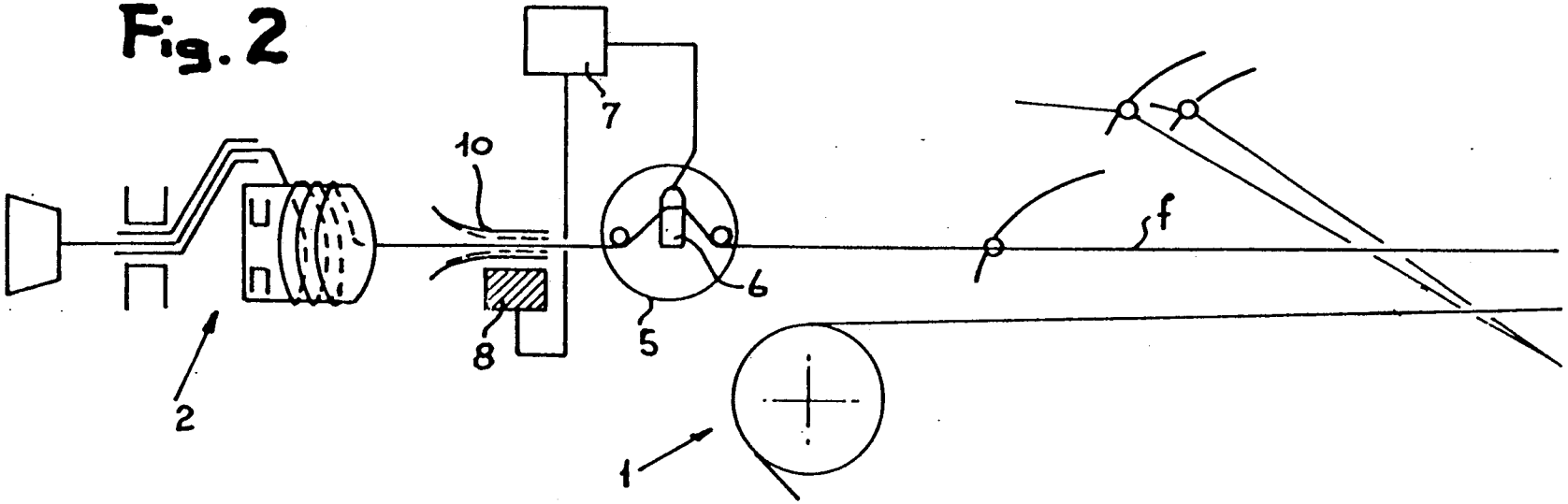

The diagram of FIG. 2 illustrates a continuous weft feed loom 1, with which there are still associated a weft feeder. 2, a warp stop motion device 5 of the same type as the previous embodiment an electronic circuit 7 to process the signals sent from the warp stop motion device, and an actuator 8, but this latter, instead of controlling the brake means of the weft feeder 2, acts on an independent brake 10, provided downstream of said feeder 2.

In either case, once a reference tension value—deemed optimal for the working being carried out on the loom—has been preset in the interface circuit 7, any variation in respect of said value of the tension of the yarn f, detected by the warp stop motion device 5, produces a control on the brake means by the actuator 8, which is adapted to restore the tension to the desired reference value. Thus, if there is less tension, the braking action will be increased (thereby to increase the tension of the yarn f). On the other hand, if the tension is higher, the braking action will be reduced (in order to reduce the tension of the yarn f).

A further embodiment of the system according to the invention, which it has been deemed superfluous to illustrate in the drawings, provides for the use —as an alternative to the signals from the warp stop motion device—of signals representing the value of weft yarn tension sent by a sensor—suitably a tensiometer—provided for the specific purpose of the invention. Said tensiometer may be positioned upstream or downstream of the warp stop motion device 5, as long as it is on the path of the weft yarn between the weft feeder and the loom. In this case, the warp stop motion device may be of the conventional type. It is to be deemed that the system, thus modified—even if less economic than those heretofore described and illustrated by FIG. 1 and 2—turns out to be more efficient, as it can make use of a sensor more adaptable to the purposes of the invention.

With each of the described embodiments of the system according to the invention—according to the nature and type of interaction between the actuator and the brake means (usually mechanical or magnetic)—it will be possible to rely on different response times, so as to obtain adjustments during the actual working cycle of the loom in which the work is being performed, or to base the adjustment on statistical concepts and thus obtain the adjustment after a certain number of cycles.

According to the weft picking characteristics, which are quite different between single-width and double-width looms, it is even possible to select between an immediate and a statistical adjustment, according to loom width.

In the event of the brake means operating in a variable way during the loom working cycle, it will not be possible to fix a reference value of the tension with which to compare the instantaneous value taken by the warp stop motion device, but a modulation of the ordinary signal controlling the action of the actuator 8 will be carried out by the signals sent from the warp stop motion device 5.

It is understood that each of the weft yarns to be picked in the loom shed has to be in a position to self-adjust its own tension in the way explained above. The sensor may however be a single sensor, if it has more possibilities of control.

The electronic interface circuit 7 will have to provide for a digiting member, for a monitoring member and for a logic. Said circuit should perform the following functions:

1—take from the code of the article being produced, containing all the working parameters of the loom for that article, the tension reference value; alternatively, said value may be input directly by the operator;

2—detect working tension values, even in different positions of the picking cycle: the operator selects the value which he deems more appropriate as reference value (according to loom behaviour and to the quality of the fabric). Said value is repeated for the other yarns if they have the same characteristics (the information being supplied by a code or by the operator) on the same loom and/or (by connection to the mains) also on other looms;

3—if braking must be modulated during operating, the tension parameters can be defined in various positions each constituting reference value for each cycle: this means that the actuator will modulate its cycle in a different way for each position;

4—the loom can also be supplied with a data-base through which, having indicated the type of weft, the loom speed and width it is possible to choose the reference value of the tension of the yarn f;

5—it is also possible to provide for a connection between the reference parameter and the working of the loom: this means that, upon weft breakage in certain steps, it is possible to operate a change in the reference tension, which will thus be continuously optimized on each yarn, in order to compensate any relative differences between the systems. In this case, a so-called "open system" will be realized.

I claim:

1. The combination of a continuous weft feed loom, of the type equipped with a weft feeder having yarn brake means and a device measuring and outputting signals of the weft yarn tension and a system to control the tension of weft yarns fed to the loom, said system including an electronic interface unit for processing the signals from the weft yarn tension measuring device, said signals representing the value of the actual weft yarn tension, and an actuator controlled by said electronic interface circuit for controlling the braking means to maintain a desired weft yarn tension, wherein the desired tension is a reference tension preset in the electronic interface circuit, and wherein the weft yarn tension measuring device is a warp stop motion device.

2. The combination as in claim 1, wherein the actuator controls means acting on the brake means of the weft feeder.

3. The combination as in claim 1, wherein the actuator controls an independent yarn brake provided downstream of the weft feeder.

4. The combination of a continuous weft feed loom, of the type equipped with a weft feeder having yarn brake means and a device measuring and outputting signals of the weft yarn tension and a system to control the tension of weft yarns fed to the loom, said systen including an electronic interface unit for processing the signals from the weft yarn tension measuring device, said signals representing the value of the actual weft yarn tension, and an actuator controlled by said electronic interface circuit for controlling the braking means to maintain a desired weft yarn tension, wherein the desired tension is a reference tension preset in the electronic interface circuit, and wherein the desired tension is variable over the loom working cycle, said electronic interface circuit comprising means for changing said reference tension during a loom working cycle.

5. The combination as in claim 4, wherein the actuator controls means acting on the brake means of the weft feeder.

6. The combination as in claim 4, wherein the actuator controls an independent yarn brake provided downstream of the weft feeder.

7. The combination of a continuous weft feed loom, of the type equipped with a weft feeder having yarn brake means and a device measuring and outputting signals of the weft yarn tension and a system to control the tension of weft yarns fed to the loom, said system including an electronic interface unit for processing the signals from the weft yarn tension measuring device, said signals representing the value of the actual weft yarn tension, and an actuator controlled by said electronic interface circuit for controlling the braking means to maintain a desired weft yarn tension, wherein the desired tension is a reference tension preset in the electronic interface circuit, and wherein the actuator controls means acting on the brake means of the weft feeder.

8. The combination as in claim 7, wherein the desired tension is variable over the loom working cycle, said electronic interface circuit comprising means for changing said reference tension during a loom working cycle.

9. The combination as in claim 7, wherein the weft yarn tension measuring device is a warp stop motion device.

10. The combination as in claim 7, wherein the actuator controls an independent yarn brake provided downstream of the weft feeder.

* * * * *